US006257187B1

(12) United States Patent
Bock

(10) Patent No.: US 6,257,187 B1
(45) Date of Patent: Jul. 10, 2001

(54) PIVOT SHAFT FOR AN INTERNAL COMBUSTION ENGINE

(75) Inventor: Allyn P. Bock, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/306,145

(22) Filed: May 6, 1999

(51) Int. Cl.[7] ..... F01L 1/26
(52) U.S. Cl. ..... 123/90.23; 123/90.4; 123/90.61
(58) Field of Search ..... 123/90.39, 90.4, 123/90.44, 90.61, 90.22, 90.23, 90.34, 502

(56) References Cited

U.S. PATENT DOCUMENTS

| | | | | |
|---|---|---|---|---|
| 2,996,050 | * | 8/1961 | Caris | 123/90.34 |
| 3,841,280 | * | 10/1974 | Lussier | 123/90.39 |
| 3,884,199 | * | 5/1975 | Irimajiri et al. | 123/90.61 |
| 3,930,471 | * | 1/1976 | Leonard et al. | 123/90.4 |
| 4,206,734 | * | 6/1980 | Perr et al. | 123/502 |
| 4,425,881 | * | 1/1984 | Lyndhurst | 123/90.39 |
| 4,662,322 | * | 5/1987 | Tamba et al. | 123/41.86 |
| 4,864,983 | | 9/1989 | Breitbarth . | |
| 5,347,965 | | 9/1994 | Decuir . | |
| 5,394,843 | | 3/1995 | Decuir . | |

* cited by examiner

*Primary Examiner*—Thomas Denion
*Assistant Examiner*—Tu M. Nguyen
(74) *Attorney, Agent, or Firm*—Todd T. Taylor

(57) ABSTRACT

An internal combustion engine includes a housing with a plurality of combustion cylinders. At least one of the combustion cylinders has a longitudinal axis which is disposed at an acute angle relative to a longitudinal axis of at least one other combustion cylinder. A camshaft is rotatably carried by the housing and includes a plurality of cams. A plurality of lever lifter assemblies are associated with respective ones of the combustion cylinders. Each lever lifter assembly includes an intake lever lifter, an exhaust lever lifter and a fuel injector lever lifter. Each of intake lever lifter, exhaust lever lifter and fuel injector lever lifter has a roller follower engaging a respective cam. A pivot shaft carried by the housing pivotally carries at least one lever lifter assembly associated with the at least one combustion cylinder and also pivotally carries at least one lever lifter assembly associated with the at least one other combustion cylinder.

11 Claims, 3 Drawing Sheets

PIVOT SHAFT FOR AN INTERNAL COMBUSTION ENGINE

TECHNICAL FIELD

The present invention relates to internal combustion engines, and, more particularly, to internal combustion engines including a lever lifter assembly carried by a pivot shaft.

BACKGROUND ART

Internal combustion engines typically include a plurality of combustion cylinders. In an internal combustion engine with a V-block configuration, a housing includes a plurality of combustion cylinders in a first bank of combustion cylinders which are disposed at an acute angle relative to a plurality of combustion cylinders in a second bank of combustion cylinders. Each of the combustion cylinders typically includes a plurality of valves associated therewith which are actuated using push rods. The push rods are attached with lever lifters, with each lever lifter having a roller follower which engages a cam on a camshaft.

With a conventional V-block configuration, two pivot shafts are provided which respectively correspond to the first bank of combustion cylinders and the second bank of combustion cylinders. Lever lifter assemblies associated with the first bank of combustion cylinders are pivotally carried by one of the pivot shafts, and lever lifter assemblies associated with the second bank of combustion cylinders are pivotally carried by the other pivot shaft.

The problem with an internal combustion engine having a V-block configuration as described above is that two separate pivot shafts are used to carry the lever lifter assembly associated with the two different banks of combustion cylinders. The use of two different pivot shafts complicates and increases the cost of the assembly process during manufacture of the internal combustion engine. Moreover, the use of two pivot shafts requires additional space within the internal combustion engine not only for the pivot shafts, but also for the range of motion of the lever lifter assemblies carried by each pivot shaft. Thus, the package size of the internal combustion engine is also increased.

The present invention is directed to overcoming one or more of the problems as set forth above.

DISCLOSURE OF THE INVENTION

In one aspect of the invention, an internal combustion engine includes a housing with a plurality of combustion cylinders. At least one of the combustion cylinders has a longitudinal axis which is disposed at an acute angle relative to a longitudinal axis of at least one other combustion cylinder. A camshaft is rotatably carried by the housing and includes a plurality of cams. A plurality of lever lifter assemblies are associated with respective ones of the combustion cylinders. Each lever lifter assembly includes an intake lever lifter, an exhaust lever lifter and a fuel injector lever lifter. Each intake lever lifter, exhaust lever lifter and fuel injector lever lifter has a roller follower engaging a respective cam. A pivot shaft carried by the housing pivotally carries at least one lever lifter assembly associated with the at least one combustion cylinder and also pivotally carries at least one lever lifter assembly associated with the at least one other combustion cylinder.

In another aspect of the invention, an internal combustion engine is assembled. A housing is provided with a plurality of combustion cylinders. At least one of the combustion cylinders has a longitudinal axis which is disposed at an acute angle relative to a longitudinal axis of at least one other combustion cylinder. A camshaft is placed within and attached to the housing. The camshaft includes a plurality of cams. A plurality of lever lifter assemblies are slid over a pivot shaft. Each lever lifter assembly is associated with a respective one of the combustion cylinders, and includes an intake lever lifter, an exhaust lever lifter and a fuel injector lever lifter. The pivot shaft pivotally carries at least one lever lifter assembly associated with at least one combustion cylinder and also pivotally carries at least one lever lifter assembly associated with at least one other combustion cylinder. The pivot shaft is positioned within and attached to the housing, whereby a roller follower of each intake lever lifter, exhaust lever lifter and fuel injector lever lifter engages a respective cam.

BEST MODE FOR CARRYING OUT THE INVENTION

Figure 1:
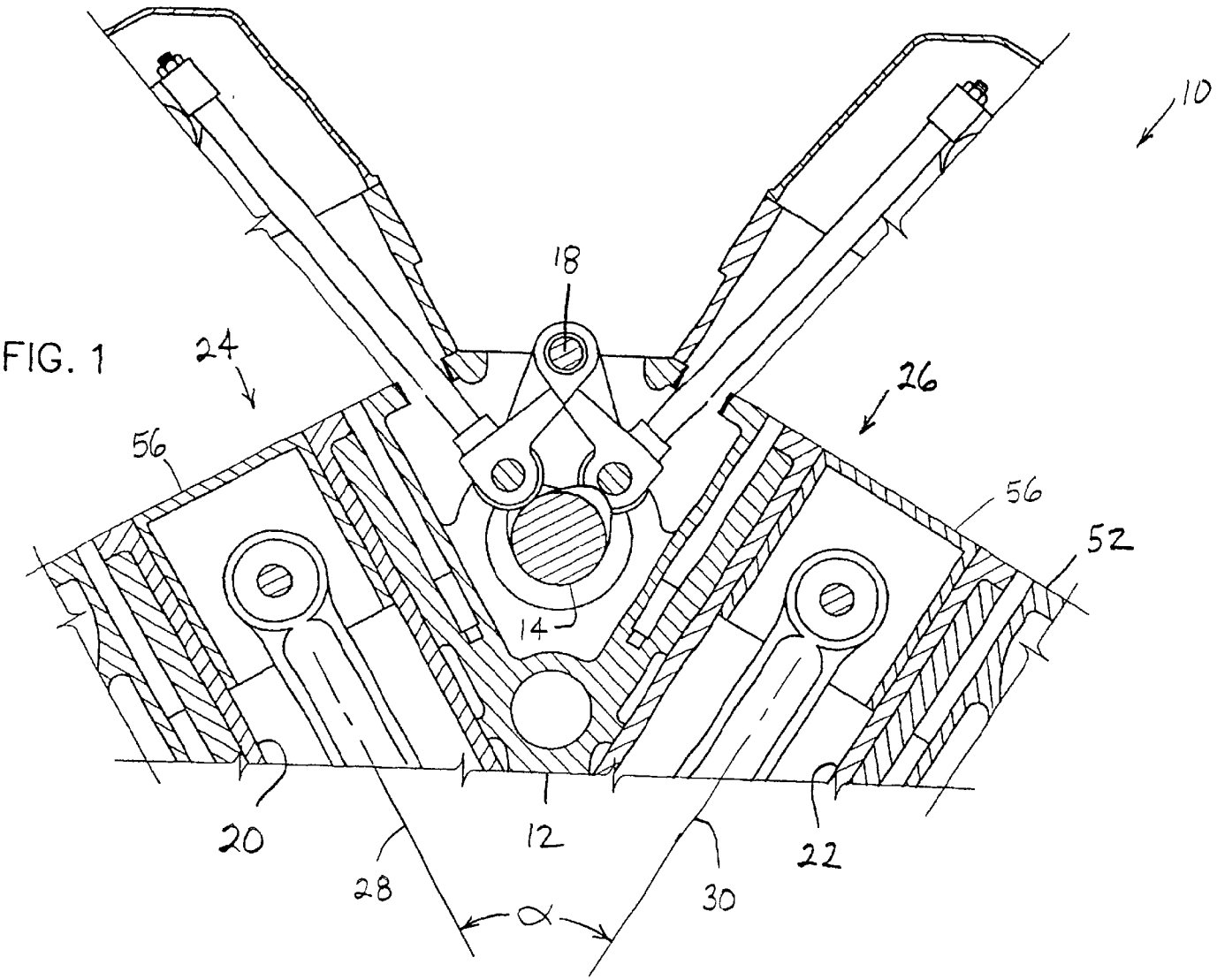
FIG. 1 is an end, sectional view of a portion of an embodiment of an internal combustion engine of the present invention.
Figure 2:
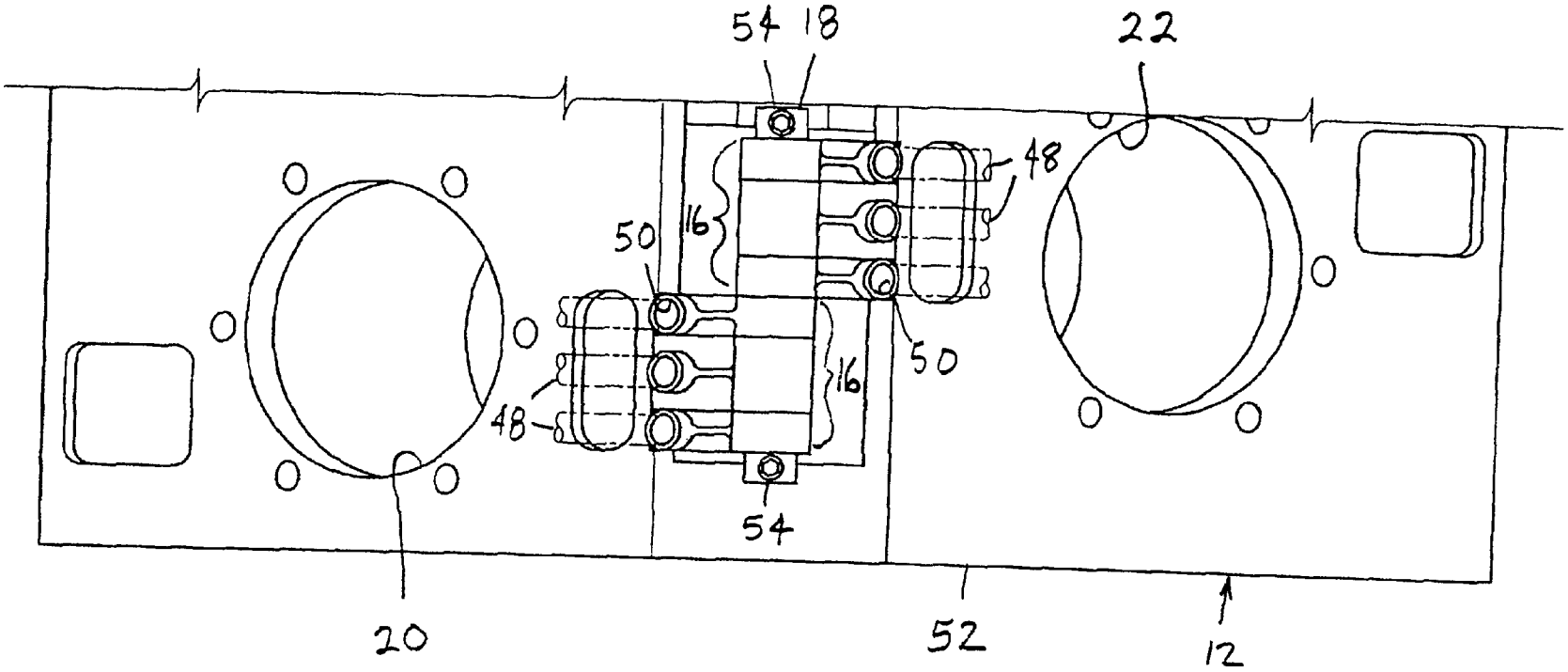
FIG. 2 is a top, fragmentary view of a portion of the internal combustion engine of FIG. 1.

Referring now to the drawings, and more particularly to FIGS. 1 and 2, there is shown a portion of an internal combustion engine 10 of the present invention. Internal combustion engine 10 includes a housing 12, a camshaft 14, a plurality of lever lifter assemblies 16 and a pivot shaft 18.

Housing 12, in the embodiment shown, has a V-block configuration with a plurality of combustion cylinders 20 and 22. Combustion cylinder 20 is one of a plurality of additional combustion cylinders (not shown) defining a first bank 24 of combustion cylinders in housing 12. Likewise, combustion cylinder 22 is one of a plurality of additional combustion cylinders (not shown) defining a second bank 26 of combustion cylinders. Each of the combustion cylinders within first bank 24 has a longitudinal axis defining a plane extending in a direction transverse to the drawing of FIG. 1, relative to longitudinal axis 28 of combustion cylinder 20. Likewise, each of the combustion cylinders in second bank 26 has a longitudinal axis which defines a plane extending in a direction transverse to the drawing of FIG. 1, relative to longitudinal axis 30 of combustion cylinder 22. Longitudinal axis 28 of combustion cylinder 20 is disposed at an acute angle $\alpha$ relative to longitudinal axis 30 of combustion cylinder 22.

Figure 3:
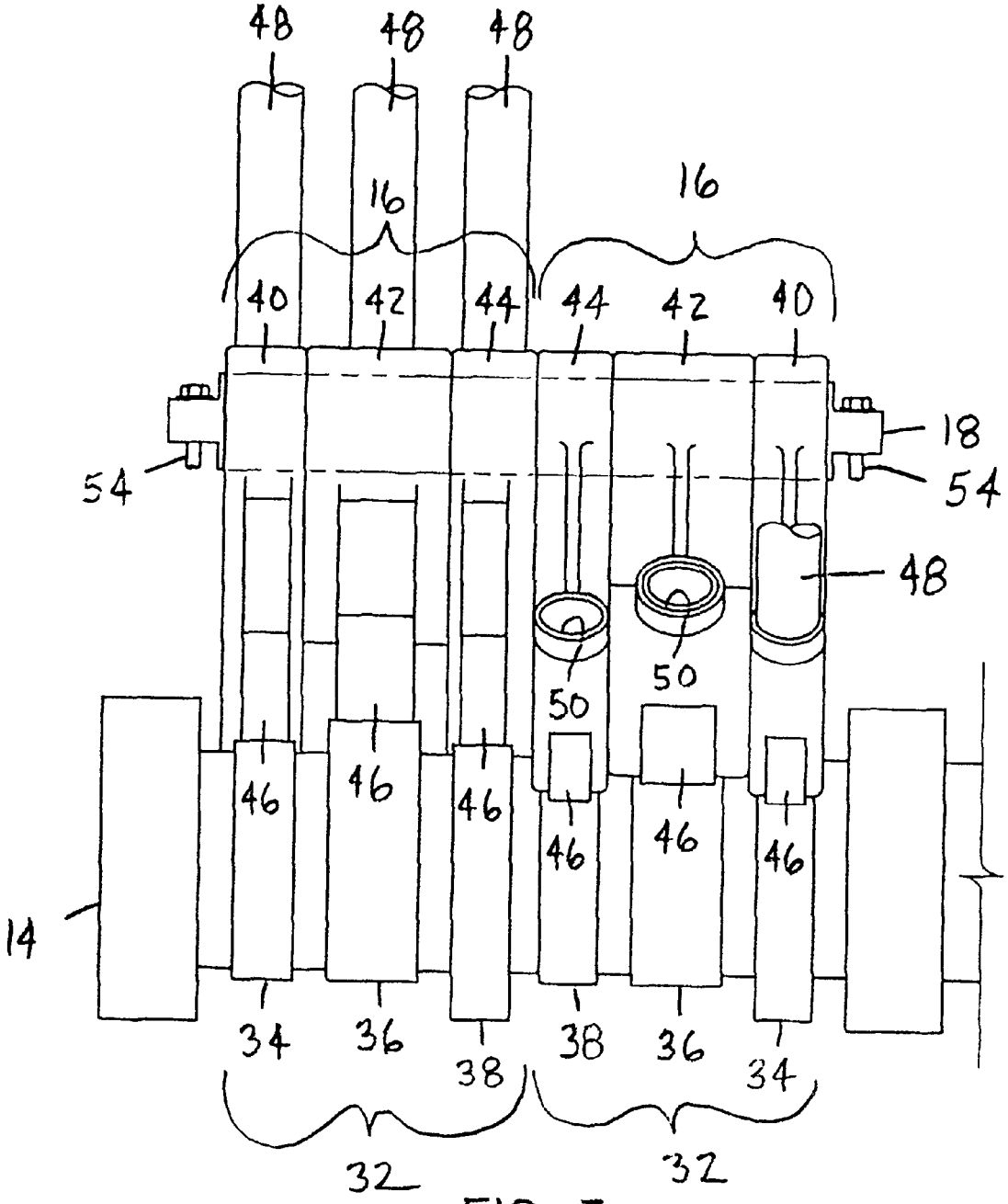
FIG. 3 is a side view of the lever lifter assembly and camshaft of FIGS. 1 and 2.

Camshaft 14 is rotatably carried by housing 12 and includes a plurality of cam sets 32, with each cam set 32 including an inlet valve cam 34, a fuel injector cam 36 and an exhaust valve cam 38 (FIG. 3). Camshaft 14 is symmetrically positioned relative to first bank 24 and second bank 26 to substantially bisect acute angle $\alpha$. Camshaft 14 may be a single camshaft carried by housing 12, or may be a segmented camshaft assembly carried by housing 12.

Each lever lifter assembly 16 is associated with a respective combustion cylinder within internal combustion engine 10, such as combustion cylinder 20 or 22. Each lever lifter assembly 16 includes an intake lever lifter 40 associated with intake valve cam 34; a fuel injector lever lifter 42 associated with fuel injector cam 36; and an exhaust lever lifter 44 associated with exhaust valve cam 38. Each of intake lever lifter 40, fuel injector lever lifter 42 and exhaust lever lifter 44 includes a roller follower 46 which rolls against and engages an associated cam 34, 36 or 38. Rotation of camshaft 14 causes oscillatory pivotal movement of lever lifters 40, 42 and 44. Each intake lever lifter 40, fuel injector lever lifter 42 and exhaust lever lifter 44 is connected with a push rod 48 which moves in a substantially axial direction during the oscillatory pivotal movement of lever lifters 40, 42 and 44. Each push rod 48 is disposed within a respective socket 50 of a lever lifter 40, 42 or 44. Each push rod 48 attached with an intake lever lifter 40 is used to actuate an intake valve in known manner; each push rod 48 attached with a fuel injector lever lifter 42 is used to actuate a fuel injector in known manner; and each push rod 48 attached with an exhaust lever lifter 44 is used to actuate an exhaust valve in known manner.

Pivot shaft 18, which as seen from FIGS. 1 and 3 is cylindrical in shape is rigidly attached to and carried by housing 12. Pivot shaft 18 pivotally carries a lever lifter assembly 16 associated with combustion cylinder 20, and also pivotally carries a lever lifter assembly 16 associated with combustion cylinder 22. As more easily seen in FIG. 2, combustion cylinder 20 in first bank 24 and combustion cylinder 22 in second bank 26 are disposed in a staggered or offset manner in an axial direction of pivot shaft 18. Housing 12 includes a block 52 associated with each pair of axially adjacent combustion cylinders. Thus, e.g., housing 12 includes eight blocks 52 if internal combustion engine 10 has a total of sixteen combustion cylinders, with eight pivot shafts 18 associated with each of the eight blocks 52. Block 52 is configured to carry a respective pivot shaft 18 at a location which is substantially symmetric relative to first bank 24 and second bank 26 such that pivot shaft 18 substantially bisects the angle $\alpha$ between longitudinal axes 28 and 30. Pivot shaft 18 may be rigidly attached to housing 12, such as by using bolts 54 at opposite ends thereof which are threadingly engaged with housing 12.

To assemble internal combustion engine 10, pistons 56 are placed within combustion cylinders 20 and 22 in known manner. Camshaft 14 is also installed within internal combustion engine 10 in known manner. A pair of lever lifter assemblies 16 are slid over pivot shaft 18. Pivot shaft 18, with two lever lifter assemblies 16 installed thereon, is then placed within the corresponding block 52 of housing 12. Bolts 54 are used to rigidly attach pivot shaft 18 to housing 12. Each push rod 48 is then installed within a corresponding socket 50 of a lever lifter 40, 42 or 44.

INDUSTRIAL APPLICABILITY

During use, pivot shaft 18 commonly carries a pair of lever lifter assemblies 16 which are respectively associated with first bank 24 and second bank 26. Rather than using two separate pivot shafts associated with first bank 24 and second bank 26, the common pivot shaft 18 associated with combustion cylinders 20 and 22 in first bank 24 and second bank 26 allows the assembly of internal combustion engine 10 to be simplified and reduces the package size of internal combustion engine 10.

Other aspects, objects and advantages of this invention can be obtained from a study of the drawings, the disclosure and the appended claims.

What is claimed is:

1. An internal combustion engine, comprising:

a housing having a plurality of combustion cylinders, at least one of said combustion cylinders in a first bank of combustion cylinders and at least one other of said combustion cylinders in a second bank of combustion cylinders;

a camshaft rotatably carried by said housing and including a plurality of cams;

a plurality of lever lifter assemblies, each said lever lifter assembly associated with a respective one of said combustion cylinders, each said lever lifter assembly including an intake lever lifter, an exhaust lever lifter and a fuel injector lever lifter, each said intake lever lifter, said exhaust lever lifter and said fuel injector lever lifter having a roller follower engaging a respective said cam; and a single pivot shaft carried by said housing, said pivot shaft having a length and being substantially cylindrical along said length and pivotally carrying at least one said lever lifter assembly associated with said first bank of combustion cylinders and at least one other said lever lifter assembly associated with said second bank of combustion cylinders.

2. The internal combustion engine of claim 1, wherein said pivot shaft carries one said lever lifter assembly associated with said first bank of combustion cylinders and one said lever lifter assembly associated with said second bank of cylinders.

3. The internal combustion engine of claim 1, wherein one of said combustion cylinders in said first bank of combustion cylinders has a longitudinal axis and one of said combustion cylinders in said second bank of combustion cylinders has a longitudinal axis, said longitudinal axes being disposed at an acute angle relative to each other.

4. The internal combustion engine of claim 3, wherein said housing has a V-block configuration, and wherein said pivot shaft is disposed at a location bisecting said acute angle between said longitudinal axes.

5. An internal combustion engine, comprising:

a housing having a plurality of combustion cylinders, at least one of said combustion cylinders having a longitudinal axis which is disposed at an acute angle relative to a longitudinal axis of at least one other said combustion cylinder;

a camshaft rotatably carried by said housing and including a plurality of cams;

a plurality of lever lifter assemblies, each said lever lifter assembly associated with a respective one of said combustion cylinders, each said lever lifter assembly including an intake lever lifter, an exhaust lever lifter and a fuel injector lever lifter, each said intake lever lifter, said exhaust lever lifter and said fuel injector lever lifter having a roller follower engaging a respective said cam; and a single pivot shaft carried by said housing, said pivot shaft having a length and being substantially cylindrical along said length, said pivot shaft pivotally carrying at least one said lever lifter assembly associated with said at least one combustion cylinder and also pivotally carrying at least one said lever lifter assembly associated with said at least one other combustion cylinder.

6. The internal combustion engine of claim 5, wherein said pivot shaft carries one said lever lifter assembly associated with said at least one combustion cylinder and one said lever lifter assembly associated with said at least one other combustion cylinder.

7. The internal combustion engine of claim 6, wherein said housing has a V-block configuration, and wherein said pivot shaft is disposed at a location bisecting said acute angle between said longitudinal axes.

8. A method of assembling an internal combustion engine, comprising the steps of:

providing a housing having a plurality of combustion cylinders, at least one of said combustion cylinders having a longitudinal axis which is disposed at an acute angle relative to a longitudinal axis of at least one other said combustion cylinder;

placing a camshaft within and attaching said camshaft to said housing, said camshaft including a plurality of cams;

sliding a plurality of lever lifter assemblies over a single pivot shaft, each said lever lifter assembly associated with a respective one of said combustion cylinders, each said lever lifter assembly including an intake lever lifter, an exhaust lever lifter and a fuel injector lever lifter, said pivot shaft having a length and being substantially cylindrical along said length, said pivot shaft pivotally carrying at least one said lever lifter assembly associated with said at least one combustion cylinder and also pivotally carrying at least one said lever lifter assembly associated with said at least one other combustion cylinder; and positioning said pivot shaft within and attaching said pivot shaft to said housing, whereby a roller follower of each said intake lever lifter, said exhaust lever lifter and said fuel injector lever lifter engages a respective said cam.

9. The method of assembling an internal combustion engine of claim 8, wherein said pivot shaft is rigidly attached to and stationarily positioned relative to said housing.

10. An internal combustion engine, comprising:

a housing having a plurality of combustion cylinders, at least one of said combustion cylinders in a first bank of combustion cylinders and at least one other of said combustion cylinders in a second bank of combustion cylinders;

a camshaft rotatably carried by said housing and including a plurality of cams;

a plurality of lever lifter assemblies, each said lever lifter assembly associated with a respective one of said combustion cylinders, each said lever lifter assembly including an intake lever lifter, an exhaust lever lifter and a fuel injector lever lifter, each said intake lever lifter, said exhaust lever lifter and said fuel injector lever lifter having a roller follower engaging a respective said cam; and a single pivot shaft carried by and rigidly attached to and stationarily positioned relative to said housing, said pivot shaft pivotally carrying at least one said lever lifter assembly associated with said first bank of combustion cylinders and at least one other said lever lifter assembly associated with said second bank of combustion cylinders.

11. The internal combustion engine of claim 10, wherein said pivot shaft has a length is substantially cylindrical along said length.

* * * * *